United States Patent [19]

Huang

[11] 4,066,170

[45] Jan. 3, 1978

[54] ON-WALL UMBRELLA HOLDER

[75] Inventor: Yueh Huang, Taipei Hsien, China /Taiwan

[73] Assignee: Lee Hon Corporation, Taipei Hsien, China /Taiwan

[21] Appl. No.: 774,488

[22] Filed: Mar. 4, 1977

Related U.S. Application Data

[63] Continuation-in-part of Ser. No. 690,002, May 26, 1976, abandoned.

[51] Int. Cl.[2] ..... A47G 25/12

[52] U.S. Cl. ..... 211/63; 211/88

[58] Field of Search ..... 211/63, 62, 88, 103, 211/60 R, 87

[56] References Cited

U.S. PATENT DOCUMENTS

| | | | |
|---|---|---|---|
| 449,173 | 3/1891 | Risdon | 211/63 |
| 1,610,026 | 12/1926 | Miller | 211/63 |
| 2,028,337 | 1/1936 | Lane | 211/63 |
| 2,426,113 | 8/1947 | Northcutt | 211/63 X |
| 2,862,626 | 12/1958 | Clare | 211/88 |
| 3,747,776 | 7/1973 | Gross | 211/88 |

FOREIGN PATENT DOCUMENTS

| | | | |
|---|---|---|---|
| 455,541 | 7/1968 | Switzerland | 211/63 |
| 319,636 | 9/1929 | United Kingdom | 211/63 |

*Primary Examiner*—Roy D. Frazier
*Assistant Examiner*—Robert W. Gibson, Jr.

[57] ABSTRACT

A wall-mountable umbrella holder comprising a hollow, essentially tubular casing having an opening at upper end and a perforated pan-like member connected at lower end for receiving and supporting a collapsed umbrella, means provided on the casing for mounting the casing against a wall, and a cup-shaped member threadedly detachably connected to the bottom of the perforated pan-like member whereby all of the perforations through the pan-like member are directed into the cup-shaped member, so that the water from a moistened umbrella disposed in the casing can drain through the perforations into the cup-shaped member for ready removal. The casing is preferably made up of two telescopic sections frictionally sliding one inside the other so that the length of the casing can be manually adjusted to various umbrellas. The pan-like member is provided with means for ventilation in order to insure air-drying and prevent mildew or mold. The cup-shaped member contains a bladed element which includes a shaft provided with a plurality of blades, so that the water collected in the cup-shaped member is prevented from splashing back to the pan-like member.

3 Claims, 3 Drawing Figures

Fig. 1
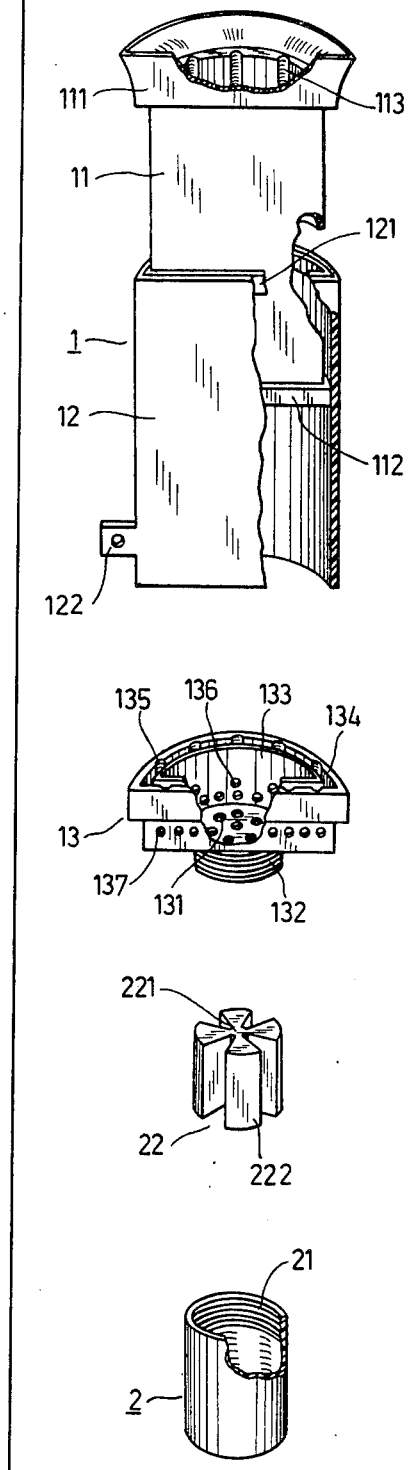
Fig. 2
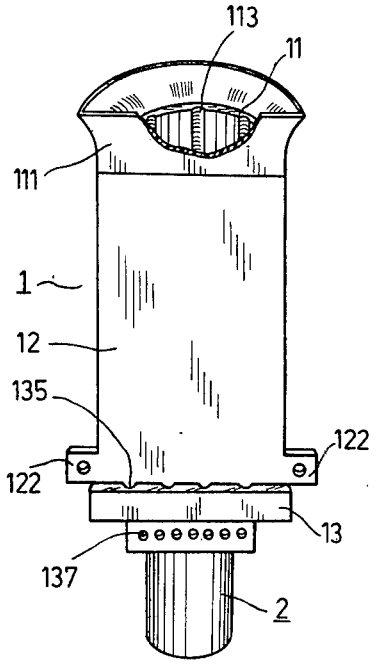
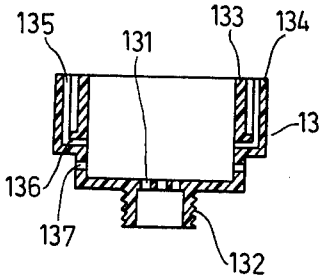
Fig. 3

ON-WALL UMBRELLA HOLDER

CROSS REFERENCE TO RELATED APPLICATION

This application is a continuation-in-part of Ser. No. 690,002, filed on May 26, 1976, now abandoned.

BACKGROUND OF THE INVENTION

This invention relates to an umbrella holder and more particularly to an umbrella holder of the type which can be mounted against a wall for holding a collapsed umbrella and which includes means for collection and removal of water drips from the umbrella.

In the development of umbrellas, many efforts have been made to provide one, such as a telescopic umbrella, which can be collapsed to form a relatively small package when not in use, while rendering a good shelter when in an opened position. However, one of the outstanding problems is that when an umbrella retaining raindrops on its canopy covering material is brought indoors, water drips from the umbrella would cause wetting of the environment. The prior art has proposed various types of racks or holders for an umbrella to solve this problem, such as those disclosed in U.S. Pat. No. 449,173 to Risdon and U.S. Pat. No. 2,028,337 to Lane and British Patent No. 319,636 to Bradshaw.

The umbrella-rack disclosed in U.S. Pat. No. 449,173 is constructed of a back plate, side plates fixed thereto, a detachable drip-cup fitting in the recess at the lower end of the racks, enclosed by the back plates and side plates, and a sliding front plate seated in grooves in the side plates and made to drop down upon the overlap with its lower edge the upper front edge of the drip-cup. Since the drip-cup is enclosed by the back plates, the side plates and the slidable front plate, the user has to slide up the front plate in order to remove the drip-cup to be emptied. Therefore, it is apparent that the Risdon's umbrella-rack is not only complicated in structure, but also inconvenient in operation. In addition, the length of the Risdon's umbrella-rack cannot be adjusted, and the water collected in the drip-cup may splash back onto the umbrella especially when the rack is used in a moving vehicle.

The U.S. Pat. No. 2,028,337 discloses an umbrella holder which can be completely folded in a self-contained unit. The construction of this umbrella holder is able to provide a convenient package when not in use, however, the interior cup serving either to collect water when in use or to contain the folded wall of the holder when not in use must have relatively large dimensions which causes the umbrella holder to be cumbersome. Also, the water collected in the cup may splash back onto the umbrella due to vibration, and the length of the umbrella holder can not be adjusted to various umbrellas.

The U.K. Patent No. 319,636 discloses an umbrella holder of the type comprising a hollow container having lugs for attachment to a support and provided at its base with a detachable cup or sump, and, carried within the detachable cup or sump is an absorbent pad or piece of spongy rubber. The U.K. Patent No. 319,636 does not teach a container telescopically adjustable to various umbrellas. Although the absorbent pad or piece of spongy rubber carried within the cup or the sump functions to prevent the collected water from splashing out, the absorbent pad or piece of spongy rubber should be removed to dry or be replaced after being wetted. This causes great inconvenience to user.

SUMMARY OF THE INVENTION

It is therefore an object of this invention to provide an umbrella holder which has novel design and structure to eliminate the above-mentioned disadvantages of the prior art.

Accordingly, it is a specific object of this invention to provide a novel structure for an umbrella holder including means for ventilation and thus preventing mildew, means for preventing the water collected from an umbrella from splashing back onto the umbrella and means for adjusting the length of the holder, the assembly being compact, good looking and convenient in use.

More specifically, this invention is directed toward an umbrella holder comprising a hollow, essentially tubular casing having an opening at the upper end thereof and a perforated pan-like member connected at the lower end for receiving and supporting a collapsed umbrella, means provided on the casing for mounting the casing against a wall and a cup-shaped member threadedly connected to the bottom of the perforated pan-like member whereby all of the perforations through the pan-like member are directed into the cup-shaped member, so that the water from a moistened umbrella disposed in the casing can drain through the perforations into the cup-shaped member for ready removal. The casing is preferably made up of two telescopic sections frictionally sliding one inside the other so that the length of the casing can be manually adjusted to contain various umbrellas. The pan-like member is provided with means for ventilation in order to insure air-drying and prevent mildew or mold. Furthermore, the cup-shaped member contains a bladed element including a shaft with blades so as to prevent the collected water from splashing back to the pan-like member and re-wetting the umbrella.

BRIEF DESCRIPTION OF THE DRAWINGS

This invention will be readily understandable from the detailed description given hereinbelow with reference to the accompanying drawings, in which:

FIG. 1 is an exploded perspective view of an umbrella holder constructed in accordance with this invention, with parts partially cut away.

FIG. 2 is a perspective view of the umbrella holder shown in FIG. 1, which the casing assumes a completely contracted position.

FIG. 3 is a sectional view of the pan-like member included in the umbrella holder of FIG. 1, illustrating ventilation means for the holder.

DETAILED DESCRIPTION OF THE PREFERRED EMBODIMENT OF THE INVENTION

Referring to FIGS. 1 and 2, the umbrella holder constructed in accordance with this invention comprises a hollow, essentially tubular casing 1 and a cup-shaped member 2 containing a bladed element 22. The casing 1 consists of two telescoping sections 11 and 12 and a perforated pan-like member 13. Section 11, at the bottom, has an enlarged portion 112 snugly engaging with the inner surface of the section 12 and frictionally slidable therein, so that the length of the casing 1 can be adjusted by sliding the sections one relative to the other. The section 12, at its top end, has an inwardly directed flange portion 121 to provide a step surface for engaging the enlarged portion 112 of the section 11 and thus to stop the section 11 from slipping out therefrom. The section 11, at the top, has a rim 111, which provides a step surface for engaging with the upper end of the section 12 and serving as a limit to the downward movement of the section 11. The upper part of rim 111 is upwardly diverged to form a hopper-like inlet for the casing, which facilitates the insertion of an umbrella. Preferably, sections 11 and 12 are of semicircular cross section, so that there is a flat surface portion extending in the longitudinal direction on which means for mounting the casing against a wall may be provided. Also, the inner surface of the sections 11 and 12 are preferably formed with a plurality of grooves 113 along their length, or otherwise are corrugated, so that when an umbrella is inserted after use, any water on the umbrella canopy will readily pass down along the casing to the cup-shaped member at the bottom thereof.

The pan-like member 13 is provided at the lower end of the section 12. As can be seen from FIGS. 1 and 3, the upper portion of the pan-like member 13 is of a cross section similar to the section 12. The pan-like member 13 includes a perforated bottom having a plurality of perforations 131, a hollow stud portion 132 perpendicularly connected to the outer face of the bottom so that all of the perforations extending through the bottom are directed into the hollow of the stud portion 132, and a side wall having a double-walled upper portion and a perforated lower portion connected to the perforated bottom. The double-walled upper portion of the side wall includes inner and outer walls 133 and 134 to define a gap therebetween having dimensions adapted to receive and fix therein part of the lower portion of the casing 1. It should be noted that the inner surface of the outer wall 134 is provided with a plurality of longitudinally extending grooves 135, each groove 135 communicates with the interior of the pan-like member via a channel 136 extending inwardly through the junction of the outer and inner walls, so that, as the lower portion of the casing 1 is fixed in position in the gap between the inner and outer walls, these grooves 135 serve as air passages for ventilation. The lower portion of the side wall of the pan-like member 13 is provided with a plurality of perforations 137 extending through the side wall at a horizontal level above the perforated bottom. With this arrangement, the perforations 137 function as ventilation means, while the water passing down to the perforated bottom will not flow out through the perforations 137.

The cup-shaped member 2, at its open end, has an internally threaded portion 21 adapted to be detachably screwed onto the stud portion 132, as shown in FIGS. 1 and 2, so that all of the perforations 131 are directed into the cup-shaped member 2 through the stud portion. With such an arrangement, an umbrella disposed in the casing 1 will be supported by the pan-like member 13, and the water from the umbrella will drain into the cup-shaped member 2 via the perforations 131 and can be readily removed by unscrewing the cup-shaped member to empty the same. The cup-shaped member 2 contains a bladed element 22 as shown in FIG. 1. The bladed element 22 includes a shaft 221 and a plurality of blades 222 connected to the shaft, each blade 222 having a cross section tapering inwardly to a point at the shaft 221. The bladed element 22, when positioned in the cup-shaped member 2, will partition the cup-shaped member into small sumps and thus shorten the free path of movement of the water collected therein. Therefore, the water collected by the cup-shaped member 2 is prevented from splashing back to the pan-like member. This is particularly necessary when the umbrella holder is utilized in an automobile. The bladed element 22 is preferably made of nonabsorbent material so that it is not necessary to dry or to replace it after use.

Means are provided for mounting the casing 1 onto the wall or a door of a building, an upright side of a desk, or an inner wall of a car. These means preferably comprise a layer of pressure-sensitive adhesive applied to the flat surface portion of the casing 1 and covered with a sheet of paper which can be removed therefrom without adverse effect on the adhesiveness of the adhesive layer. Thus, the umbrella holder may be readily fixed for use by any person without necessity of tools such as hammers and screwdrivers, etc. Of course, conventional fastening means such as a pair of lugs 122 as best shown in FIG. 2 may be additionally included.

While the sections 11 and 12 are shown having a semicircular cross section, they may be made having various shapes such as triangular, rectangular, or any other multisided cross section. The casing 1, as shown, comprises two sections, however, it may be made of only one section or more than two sections. All the components are made of plastic, hard rubber, metal or other suitable material, however, the cup-shaped member 2 can advantageously be made of transparent material such as cellulose plastic or acrylic plastic so that the amount of the water collected therein can be observed from outside and thus the cup-shaped member 2 may be detached to pour out the water when necessary.

Although the features and advantages of the umbrella holder of this invention will be readily apparent from the above description, they are briefly summarized hereinafter. The cup-shaped member of the umbrella holder serves to receive the water from an umbrella and provide good ventilation inside the holder so that any water remaining on the umbrella may be rapidly air-dried and thus be prevented from forming mildew. Furthermore, the cup-shaped member is threadedly detachably connected at the bottom of the holder, so that it is very easy and convenient to unscrew the cup-shaped member for emptying. The cup-shaped member is formed in a compact and closed structure and contains a bladed element, so that the water collected therein will not splash out, particularly when used in a car. In practical use, the greatest advantage of the umbrella holder of this invention is that the holder has a telescopic casing so that the space occupied by the holder is small, while the holder may be extended or adjusted to receive a longer umbrella. This is particularly advantageous and suitable for a collapsible umbrella.

While a preferred embodiment has been shown and described, various modifications will be apparent, in the light of this disclosure, to those skilled in the art. All such modiciations which basically rely on the teachings through which this invention has advanced the prior art are properly considered within the spirit and scope of this invention, as defined in the apended claims.

What is claimed is:

1. A wall-mountable umbrella holder comprising:

a hollow, essentially tubular casing having an opening at an upper end and a perforated pan-like member connected at the lower end for receiving and supporting a collapsed umbrella, said pan-like member including a perforated bottom, a side wall having a double-walled portion defining a gap between the two walls for engaging the lower end of the tubular casing and a perforated lower portion connected between said double-walled portion and said perforated bottom, and a hollow stud portion connected to the outer face of said perforated bottom, all said perforations in said perforated bottom communicating with the inside of the stud portion;

means, provided on said casing, for mounting said casing against a wall; and a cup-shaped member detachably connected to said stud portion of said perforated pan-like member, said cup-shaped member containing therein a bladed element for splash prevention, whereby the water from a moistened umbrella disposed in the casing can drain through said perforations in said pan-like member into said cup-shaped member for ready removal, and whereby air can flow through the perforations in the perforated lower portion of said side wall of said pan-like member to dry the inside of the casing and the umbrella.

2. A wall-mountable umbrella holder as claimed in claim 1, wherein the casing is made up of at least two telescoping sections frictionally sliding one inside the other so that the length of the casing can be manually adjusted to accommodate various sizes of umbrellas.

3. A wall-mountable umbrella holder as claimed in claim 1, wherein the double-walled upper portion of the side wall of the pan-like member includes ventilation channels provided on the inner surface of its outer wall, extending from the outside to the inside of the pan-like member.

* * * * *